US005896945A

United States Patent [19]

Boelling

[11] Patent Number: 5,896,945

[45] Date of Patent: Apr. 27, 1999

[54] LADDER SAFETY TIP STRAP

[75] Inventor: James E. Boelling, Des Moines, Iowa

[73] Assignee: Wy-Tech, Inc., Des Moines, Iowa

[21] Appl. No.: 08/547,498

[22] Filed: Oct. 24, 1995

[51] Int. Cl.[6] ..... E06C 7/00

[52] U.S. Cl. ..... 182/107; 182/129; 182/207

[58] Field of Search ..... 182/107, 129, 182/207, 209–213; 24/422

[56] References Cited

U.S. PATENT DOCUMENTS

| | | | |
|---|---|---|---|
| 124,940 | 3/1872 | Edmunds . | |
| 444,632 | 1/1891 | Goosmann . | |
| 473,852 | 4/1892 | McQuillan . | |
| 531,534 | 12/1894 | Howard . | |
| 1,010,832 | 12/1911 | Welden | 182/25 |
| 2,470,053 | 5/1949 | Salisbury . | |
| 2,909,236 | 10/1959 | Rabelos | 182/207 |
| 3,070,188 | 12/1962 | Scruby | 182/163 |
| 4,450,937 | 5/1984 | Broughton . | |
| 4,974,699 | 12/1990 | Boring . | |
| 5,529,145 | 6/1996 | Alfred | 182/107 |
| 5,604,961 | 2/1997 | Cole | 24/442 |

*Primary Examiner*—Alvin Chin-Shue
*Attorney, Agent, or Firm*—Zarley, McKee, Thomte, Voorhees & Sease

[57] ABSTRACT

A ladder tie strap is wrapped around adjacent rungs of upper and lower ladder sections in an extension ladder to prevent the upper ladder section from accidentally retracting relative to the lower ladder section. A fair of tie straps may also be secured to the upper end of the ladder and fastened to a ladder support structure to stabilize the ladder against lateral movement. The structure may be a wall or a wire, and when a wire the straps are wrapped around the wire and around the ladder rung or ladder side members.

6 Claims, 8 Drawing Sheets

LADDER SAFETY TIP STRAP

BACKGROUND OF THE INVENTION

Ladders are all too often involved in accidents causing injuries to those using them. There are several different situations in which these accidents occur. Extension ladders have mechanical lock means for keeping the upper section extended but on occasion the mechanical lock is not fully engaged with a rung of the lower section, thereby allowing the upper ladder section to be retracted along the lower section.

Another situation is where the ladder is extended and the upper end is leaning on a wall such that a shifting of weight on the ladder can cause the ladder to slide laterally one direction or the other, causing the ladder to fall.

A third situation is where the upper end of the ladder is placed on a wire such as when cable TV lines are being worked on. The upper end of the ladder can slide along the wire laterally in either direction.

A typical way of stabilizing the ladder when leaning against a wall or wire is to have a person standing on the grounds holding the ladder against undesired movement. This is obviously inefficient and unreliable for preventing ladder accidents.

SUMMARY OF THE INVENTION

In one embodiment of the invention, a safety tie strap is secured to a lower rung of an upper ladder section of an extension ladder and is wrapped twice around an adjacent rung of the lower ladder section. Strips of Velcro fasteners are provided on the top and bottom sides of the tie strap and engage each other when wrapped around the ladder rungs. A finger loop is provided at the outer end of the strap to facilitate pulling the strap tight about the rungs and releasing the strap when the ladder sections are to be extended or contracted.

The strap may be connected to a rung of the upper section through use of "D" rings or by being fastened to the rung through the use of rivets or screws.

In another embodiment of the invention, a pair of tie straps are secured to the upper end of the upper ladder section and extend outwardly to a support structure, such as a wall where they are fastened to the wall through the use of nails or screws, thereby stabilizing the ladder against sliding laterally one direction or the other. The inner ends of the strap may be fastened or wrapped around the ladder side members or ladder rung. The support structure can be a wire such as a cable TV wire and in this case the straps are wrapped around the wire and then back around either the ladder rung or side members, with the Velcro fastener securing the straps against being unfastened.

DESCRIPTION OF THE PREFERRED EMBODIMENT

Figures 1, 2:
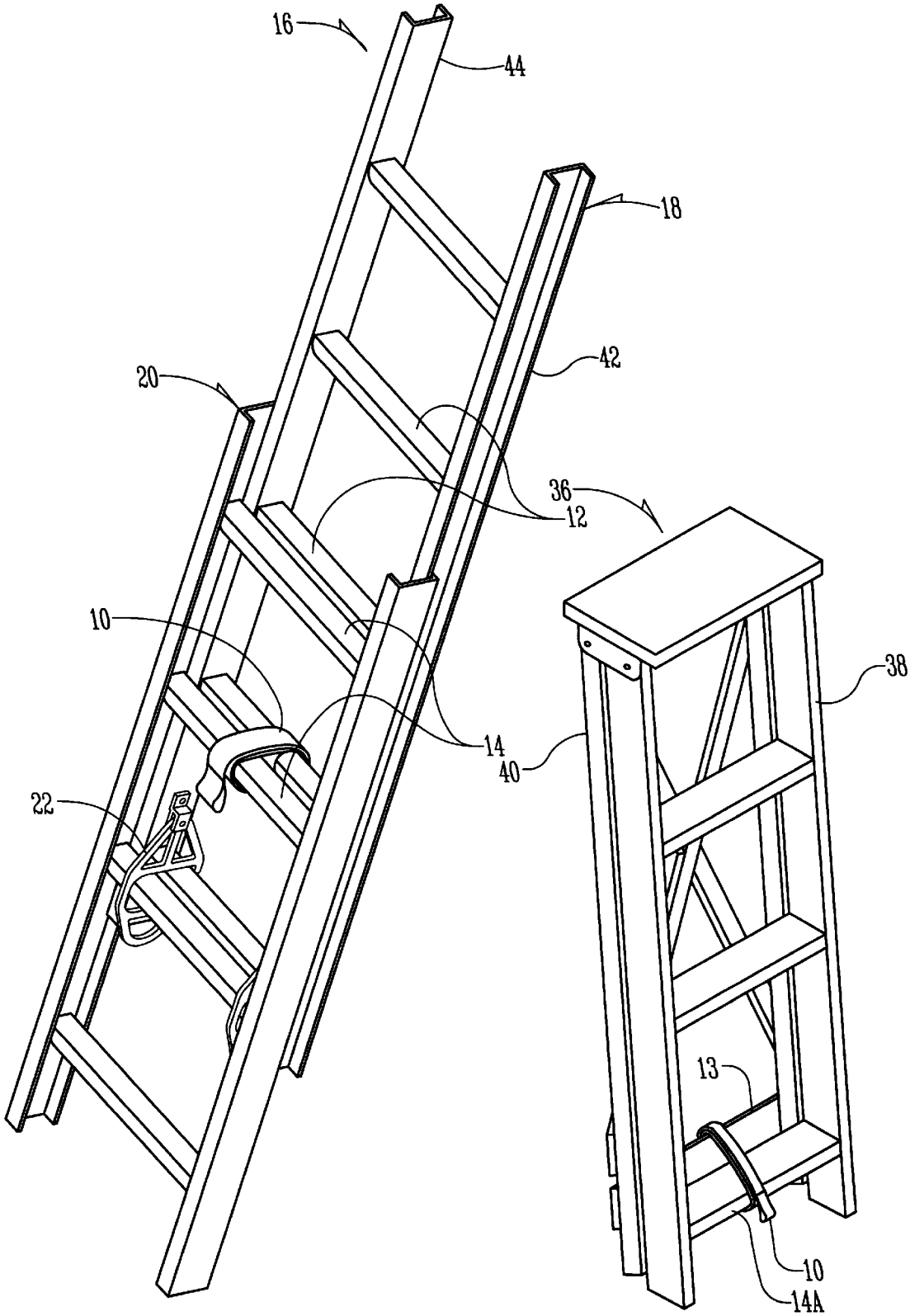
FIG. 1 is a perspective view of an extension ladder having adjacent rungs of the upper and lower sections interlocked by a tie strap being wrapped around them.
FIG. 2 is a perspective view similar to FIG. 1 but showing the tie strap used on a step ladder for preventing the front and back sections from pivoting to an open position.

The ladder safety tie strap of this invention is referred to generally in FIG. 1 by the reference numeral 10 and is shown wrapped around adjacent rungs 12 and 14 of an extended extension ladder 16 having an upper section 18 and a lower section 20.

A mechanical ratcheting type locking device 22 is conventionally provided for locking rungs of the upper and lower ladder sections together to prevent the upper ladder section from falling. The safety tie strap 10 is a back-up locking means for insuring that the upper ladder section is not inadvertently retracted, thereby injuring the user of the ladder.

Figure 6:
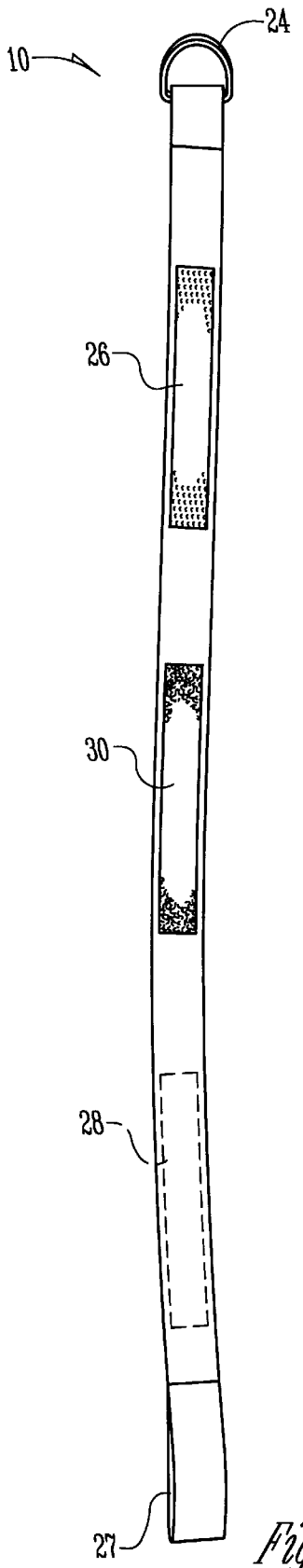
FIG. 6 is a perspective view of one side of the tie strap.
Figure 7:
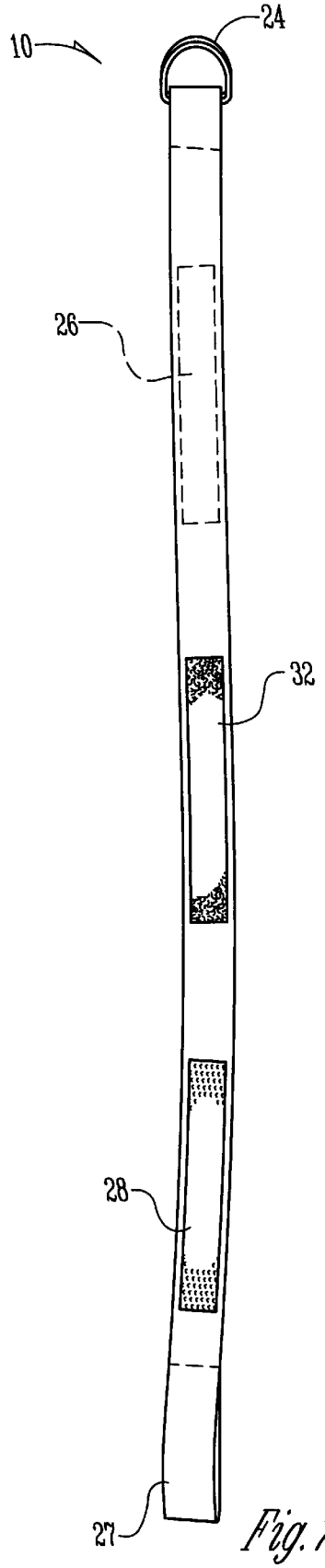
FIG. 7 is a view similar to FIG. 6 but showing the opposite side of the tie strap.

In FIGS. 6 and 7 the safety tie strap 10 is illustrated, one side being shown in FIG. 6 and the opposite side seen in FIG. 7. The tie strap 10 includes a pair of "D" rings 24 at one end and a finger loop 27 at the opposite end. Along the length of the strap on both sides are strips of Velcro fastening elements, including hook strips 26 and 28, and loop strips 30 and 32. It is to be understood that the hook and loop strips can be continuous along the opposite sides of the strap.

Figure 3:
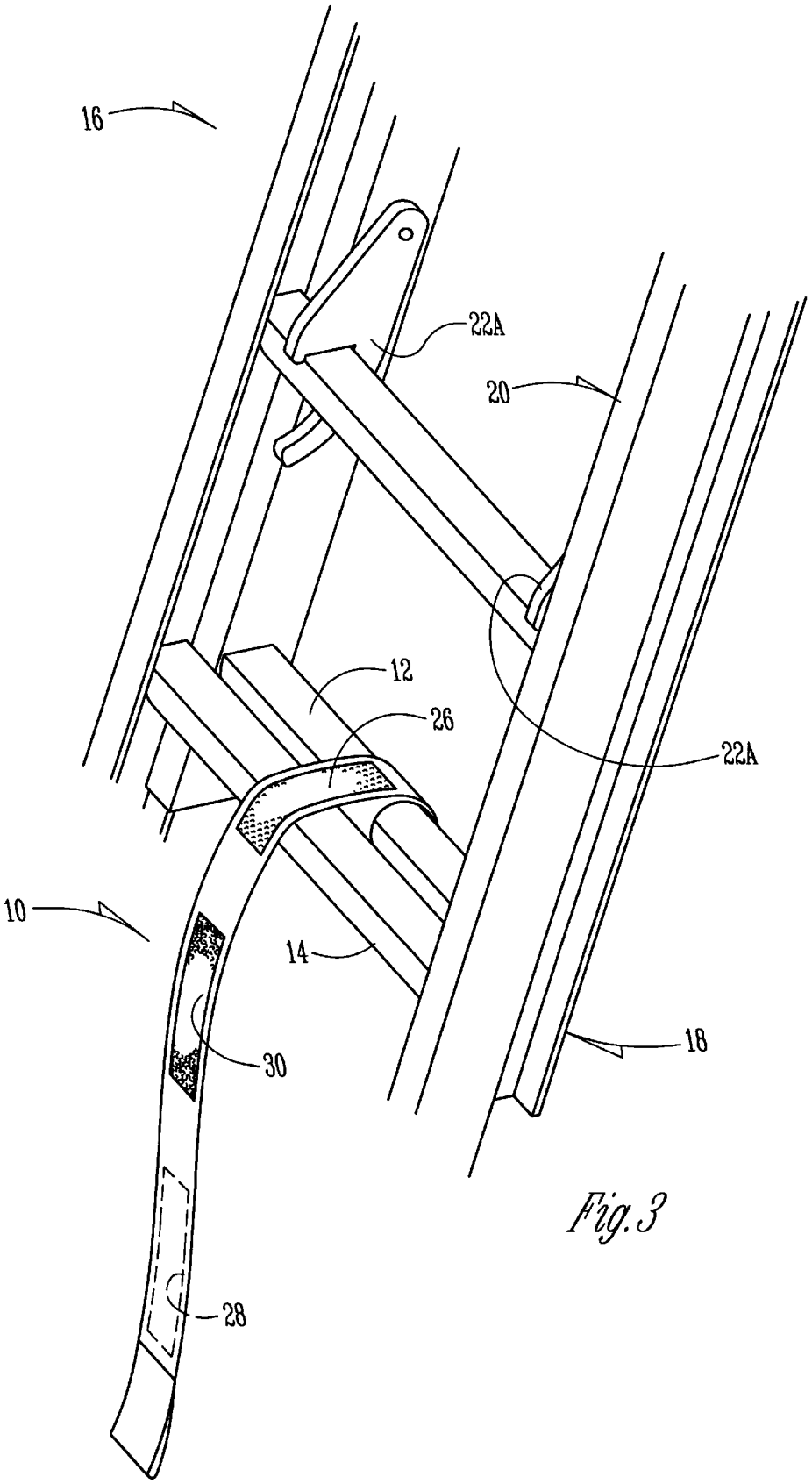
FIG. 3 is a fragmentary perspective view of an extension ladder with one end of the tie strap secured to a lower rung on the upper ladder section.
Figure 4:
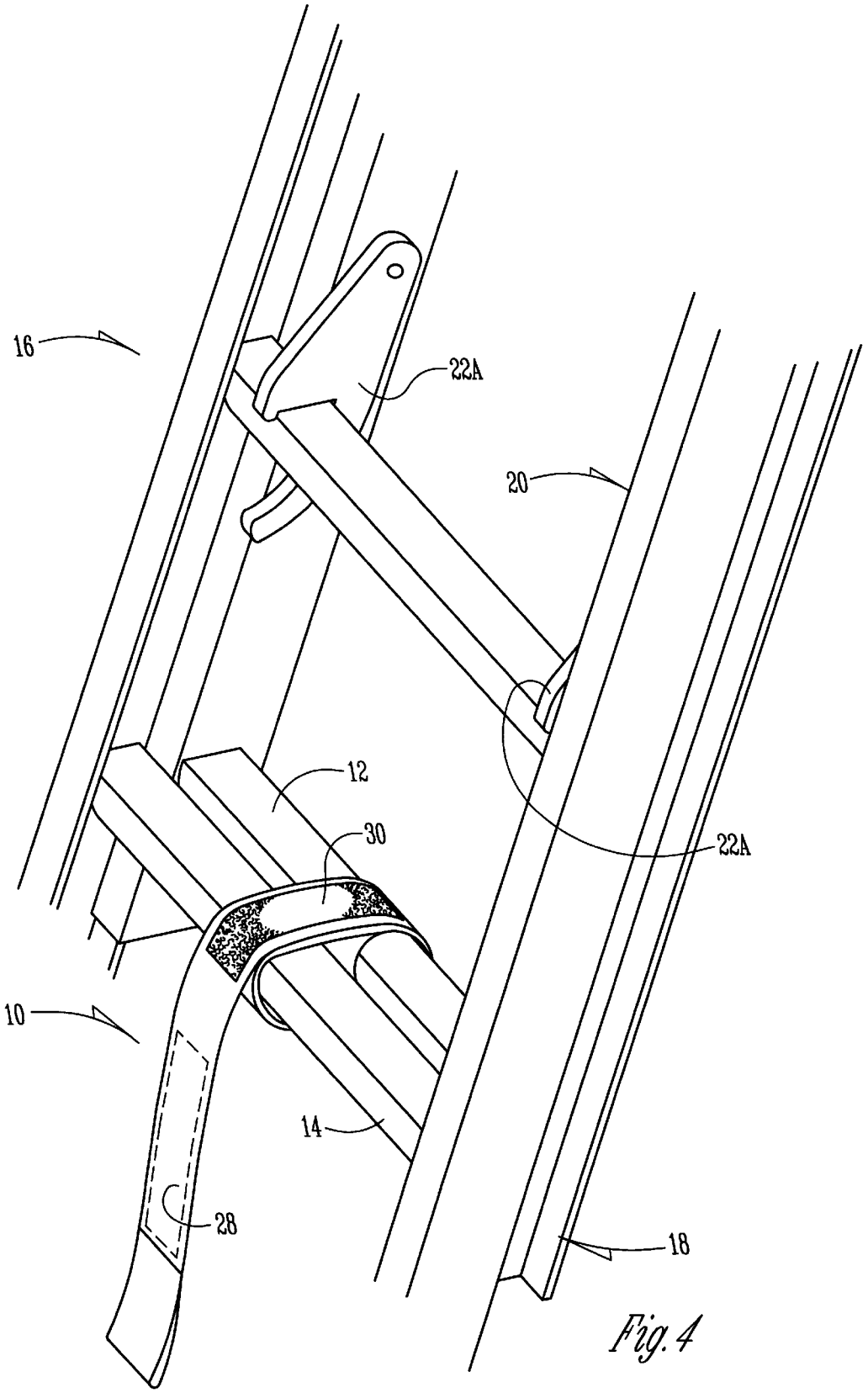
FIG. 4 is a view similar to FIG. 3 but showing the tie strap partially wrapped around the adjacent ladder rungs.

In FIG. 3 the inner end of the strap end is wrapped around the rung 12 of the upper ladder section 18 by the outer end of strap being threaded through the "D" rings 24. The strap 10 is then first wrapped once around the rungs 12 and 14 as seen in FIG. 4, and then a second wrapping occurs to finalize the wrapping as seen in FIG. 1. The finger loop 27 allows the strap to be pulled tight around the rungs 12 and 14, and to cause the Velcro hook and loop fasteners to become fully engaged. The finger loop is positioned on the front side of the ladder when it is fully wrapped twice around the rungs as seen in FIG. 1, such that it is easily accessible for operating the strap.

Figure 5:
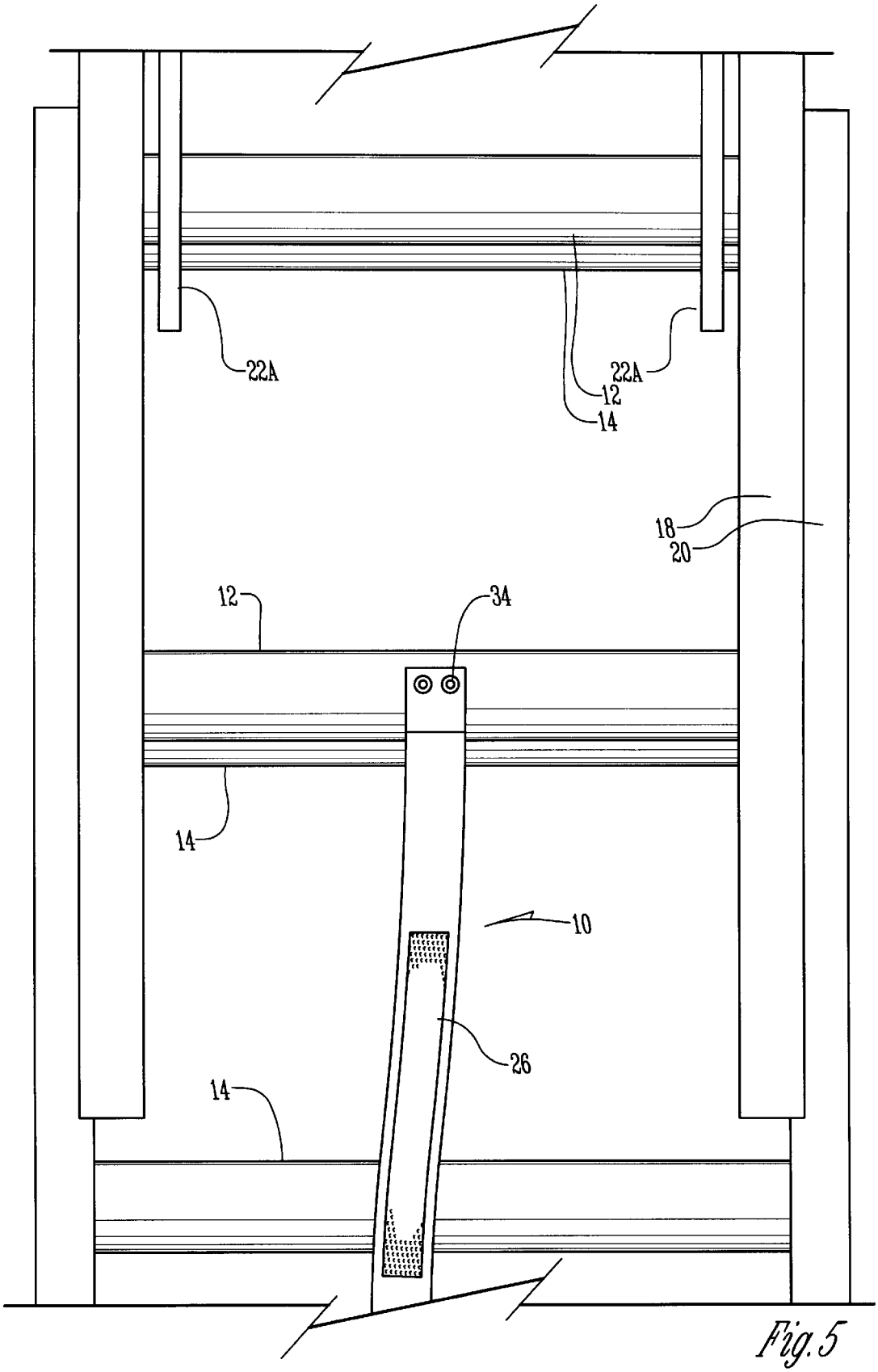
FIG. 5 is a fragmentary elevational view of an extension ladder with the tie strap secured to a lower rung of the upper section through the use of rivets.

In FIG. 5, rivets 34 are used to fasten the inner end of the strap into the rung 12 of the upper ladder section 18, in lieu of the "D" rings 24.

In FIG. 2 a step ladder 36 is shown having a front section 38 pivotally connected to a back section 40 and held in a closed storage condition by the safety tie strap 10 being wrapped around the rungs 13A and 14A.

Figure 8:
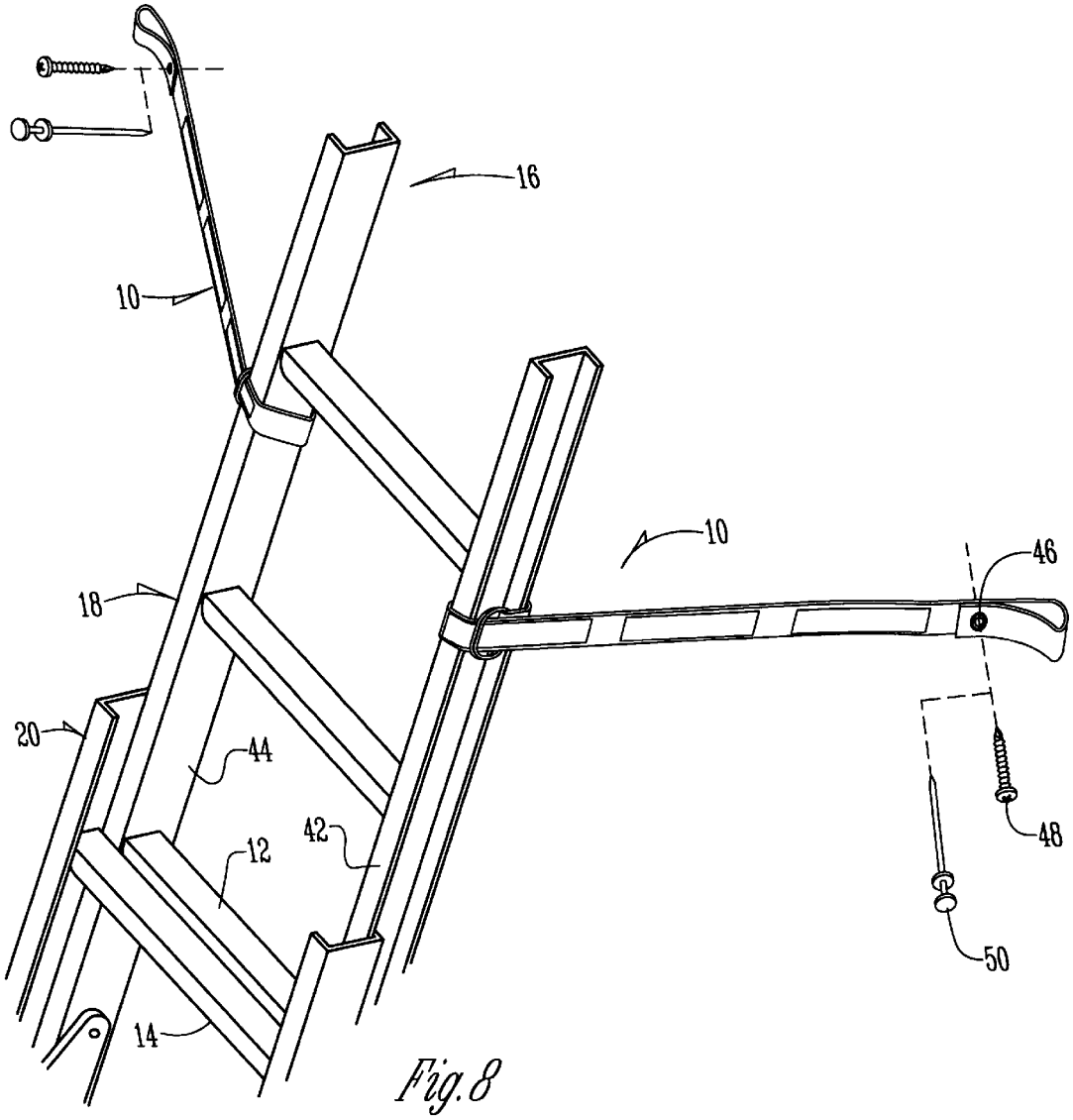
FIG. 8 is a fragmentary perspective view of an extension ladder with a pair of tie straps secured to the upper end of the upper section for being fastened to a support structure through the use of nails or screws.
Figure 9:
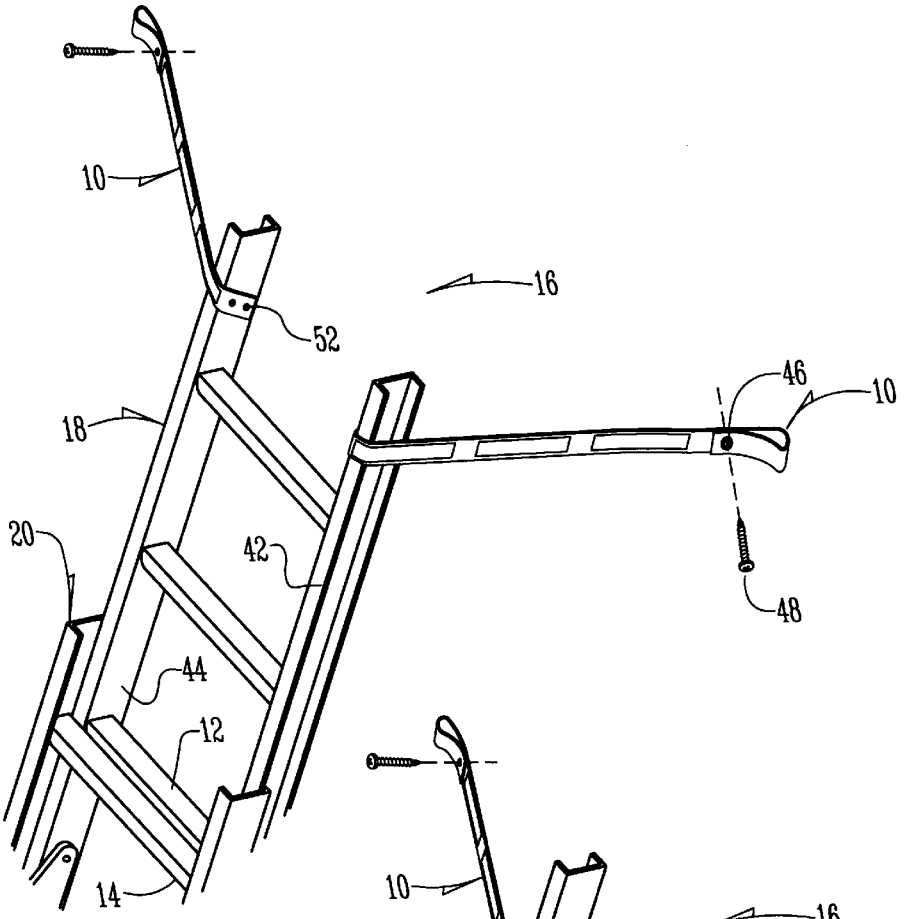
FIG. 9 is a view similar to FIG. 8 but showing the inner ends of the tie straps being fastened to the upper ladder section side member through the use of rivets.
Figure 10:
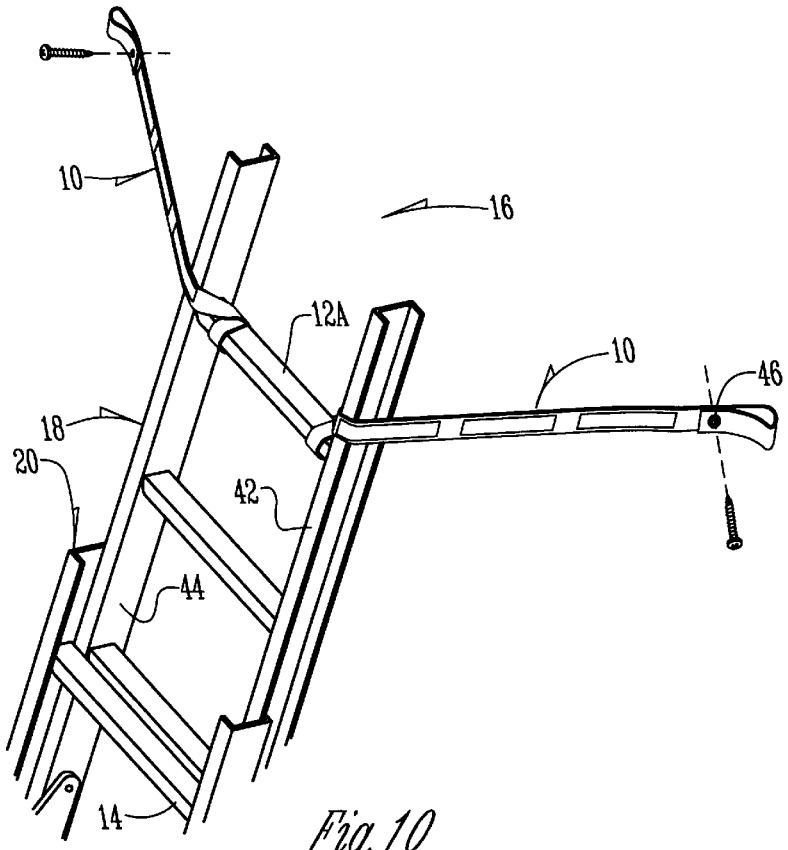
FIG. 10 is a view similar to FIGS. 8 and 9 but showing the inner ends of the tie straps being wrapped around a rung on the upper end of the upper ladder section.

In FIGS. 8–10 a pair of straps 10 are utilized and connected at their inner ends to the upper end of the upper ladder section 18. In FIG. 8 the inner ends of the straps 10 are wrapped around the ladder side members 42 and 44 using the "D" rings 24. The outer ends of the straps 10 include a grommet 46 for receiving a pan-head screw 48 or a double head scaffold type nail 50, which is driven into a support structure such as a wall. It is seen that the ladder is stabilized against lateral movement along the wall through this arrangement.

In FIG. 9 the inner ends of the straps 10 are secured to the ladder side frame members 42 and 44 by rivets 52, engaging the inner face of the side frame members, thereby not interfering with the sliding of the top ladder section 18 relative to the bottom ladder section 20.

In FIG. 10 the inner ends of the straps 10 are wrapped around the rung 12A, utilizing the "D" rings 24.

Figure 11:
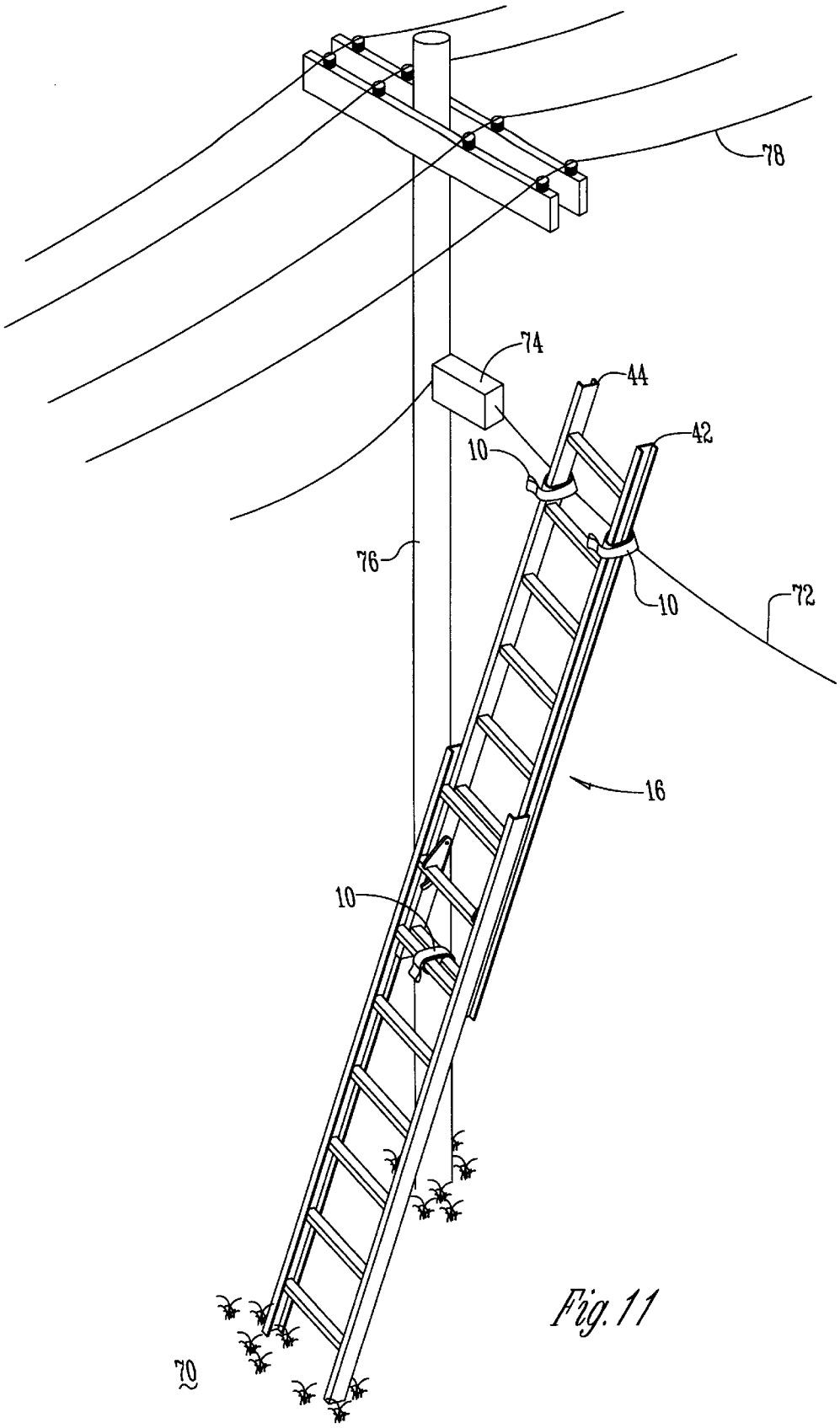
FIG. 11 is a fragmentary perspective view of an extension ladder leaning on a wire and being secured to the wire by a pair of tie straps being wrapped around the wire and the ladder side members.

In FIG. 11 the extension ladder 16 is seen with its lower end on the ground 70 and its upper end leaning against a cable TV line 72, adjacent a control box 74 on a pole 76 which also supports power lines 78. It is seen that the safety tie straps 10 are wrapped around the line 72 and then around the side members 42 and 44, such that the ladder cannot slide laterally in either direction.

What is claimed is:

1. A ladder having first and second sections movable relative to each other, each of said sections having front and back sides, opposite side members, upper and lower ends and rungs extending between said opposite side members, a rung on one of said sections being positioned closely adjacent a rung on the other of said sections, a strap having front and back sides and opposite ends, fastening means securing one of said ends to one of said rungs, hook fastening means on one side on said strap and loop fastening means on the other side of said strap, said strap being wrapped around said adjacent rungs such that said ladder sections are releasably locked together by said hooks engaging said loops, said ladder being an extension ladder and said first and second sections having top and bottom ladder sections which are longitudinally moveable relative to each other by being longitudinally extendible and retractable, said one rung being at the lower end of said upper section, and said strap being wrapped around said adjacent rungs twice, strips of hooks and loops alternate along each side of said strap with one strip of loops and one strip of hooks on one side and one strip of hooks and one strip of loops on the other side, and said strips of hooks and strips of loops being spaced apart along the length of said strap whereby at least two strips of hooks engage at least two strips of loops when said strap is wrapped around said adjacent rungs twice.

2. The ladder of claim 1 and a finger loop fastening means is provided at the other end of said strap for pulling said strap tight around said adjacent rungs and causing said hooks and loops to become engaged, and releasing said strap from being wrapped around said adjacent rungs.

3. The ladder of claim 2 wherein said strap is of such a length that when it is wrapped around said adjacent rungs twice said finger loop is positioned on the front side of the lower ladder section closely adjacent said rung on said lower ladder section.

4. The ladder of claim 1 wherein said fastening means on said one end of said straps immovably secures said strap one end to said one rung.

5. The ladder of claim 1 wherein said fastening means is further defined as a rivet extending through said strap and into said one ring.

6. The ladder of claim 1 wherein said fastening means on said one end of said strap is a ring through which said strap is threaded with said strap being wrapped around said one rung before it is wrapped around said adjacent rung.

* * * * *